US010070238B2

(12) United States Patent
Jones et al.

(10) Patent No.: US 10,070,238 B2
(45) Date of Patent: Sep. 4, 2018

(54) SYSTEM AND METHODS FOR IDENTIFYING AN ACTION OF A FORKLIFT BASED ON SOUND DETECTION

(71) Applicant: Walmart Apollo, LLC, Bentonville, AR (US)

(72) Inventors: Matthew Allen Jones, Bentonville, AR (US); Aaron James Vasgaard, Fayetteville, AR (US); Nicholaus Adam Jones, Fayetteville, AR (US); Robert James Taylor, Rogers, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 15/696,976

(22) Filed: Sep. 6, 2017

(65) Prior Publication Data

US 2018/0077509 A1 Mar. 15, 2018

Related U.S. Application Data

(60) Provisional application No. 62/393,765, filed on Sep. 13, 2016.

(51) Int. Cl.
*H04R 29/00* (2006.01)
*H04R 1/40* (2006.01)

(52) U.S. Cl.
CPC ..... *H04R 29/008* (2013.01); *H04R 1/406* (2013.01)

(58) Field of Classification Search
CPC ..... H04R 29/008; H04R 1/406
USPC ..... 381/56, 92
See application file for complete search history.

(56) References Cited

U.S. PATENT DOCUMENTS 4,112,419 A 9/1978 Kinoshita et al.
4,247,922 A * 1/1981 Jackson ..... B66F 9/0755 128/201.19
4,605,924 A 8/1986 Marini et al.
4,950,118 A 8/1990 Mueller et al.
5,471,195 A 11/1995 Rickman
(Continued)

FOREIGN PATENT DOCUMENTS

CA 2494396 C 10/2013
EP 2884437 A1 6/2015
(Continued)

OTHER PUBLICATIONS

Bacheldor, Beth, M/A-COM Combines RFIDa nd Sensors for Smarter Forklift, RFID Journal Virtual Events, last viewed May 25, 2016.

(Continued)

*Primary Examiner* — David Ton
(74) *Attorney, Agent, or Firm* — McCarter & English, LLP

(57) ABSTRACT

Described in detail herein are methods and systems for identifying actions performed by a forklift based on detected sounds in a facility. An array of microphones can be disposed in a facility. The microphones can detect various sounds and encode the sounds in an electrical signal and transmit the sounds to a computing system. The computing system can determine the sound signature of each sound and based on the sound signature the chronological order of the sounds and the time interval in between the sounds the computing system can determine the action being performed by the forklift which is causing the sounds.

20 Claims, 4 Drawing Sheets

(56) References Cited

U.S. PATENT DOCUMENTS

| | | | | |
|---|---|---|---|---|
| 5,712,830 | A | 1/1998 | Ross et al. | |
| 6,296,081 | B1 | 10/2001 | Nagai et al. | |
| 6,507,790 | B1 * | 1/2003 | Radomski | G01H 1/003 702/39 |
| 6,633,821 | B2 | 10/2003 | Jackson et al. | |
| 7,047,111 | B2 | 5/2006 | Schliep et al. | |
| 7,162,043 | B2 | 1/2007 | Sugiyama et al. | |
| 7,379,553 | B2 | 5/2008 | Nakajima et al. | |
| 7,647,827 | B2 * | 1/2010 | Pelecanos | G01H 1/00 340/442 |
| 7,957,225 | B2 | 6/2011 | Steadman | |
| 8,059,489 | B1 | 11/2011 | Lee et al. | |
| 8,091,421 | B2 | 1/2012 | Perl et al. | |
| 8,188,863 | B2 | 5/2012 | Rinkes et al. | |
| 8,412,485 | B2 | 4/2013 | Brown | |
| 8,620,001 | B2 | 12/2013 | Peachey et al. | |
| 8,682,675 | B2 | 3/2014 | Togami et al. | |
| 8,706,540 | B2 | 4/2014 | Mangat et al. | |
| 9,367,831 | B1 | 6/2016 | Besehanic | |
| 9,892,744 | B1 * | 2/2018 | Salonidis | G10L 25/51 |
| 2005/0281135 | A1 | 12/2005 | Willins et al. | |
| 2006/0197666 | A1 | 9/2006 | Babich et al. | |
| 2007/0080025 | A1 | 4/2007 | Yamada et al. | |
| 2008/0011554 | A1 | 1/2008 | Broesel et al. | |
| 2008/0136623 | A1 | 6/2008 | Calvarese | |
| 2009/0190769 | A1 | 7/2009 | Wang et al. | |
| 2010/0110834 | A1 | 5/2010 | Kim et al. | |
| 2010/0176922 | A1 | 7/2010 | Schwab et al. | |
| 2012/0070153 | A1 | 3/2012 | Jonsson | |
| 2012/0071151 | A1 | 3/2012 | Abramson et al. | |
| 2012/0081551 | A1 | 4/2012 | Mizuno et al. | |
| 2012/0206264 | A1 | 8/2012 | Gannot et al. | |
| 2012/0214515 | A1 | 8/2012 | Davis et al. | |
| 2012/0330654 | A1 | 12/2012 | Angell et al. | |
| 2013/0024023 | A1 | 1/2013 | Siegel et al. | |
| 2014/0167960 | A1 | 6/2014 | Argue et al. | |
| 2014/0222521 | A1 | 8/2014 | Chait | |
| 2014/0232826 | A1 | 8/2014 | Halata | |
| 2014/0379305 | A1 | 12/2014 | Kumar | |
| 2015/0103627 | A1 | 4/2015 | Bartov et al. | |
| 2015/0103628 | A1 | 4/2015 | Bartov et al. | |
| 2015/0262116 | A1 | 9/2015 | Katircioglu et al. | |
| 2015/0319524 | A1 | 11/2015 | Wang et al. | |
| 2016/0163168 | A1 | 6/2016 | Bray et al. | |

FOREIGN PATENT DOCUMENTS

| | | | |
|---|---|---|---|
| FR | 2774474 | A1 | 8/1999 |
| TW | 1426234 | | 2/2014 |
| WO | 2005073736 | A2 | 8/2005 |
| WO | 2009003876 | A1 | 1/2009 |
| WO | 2012119253 | A1 | 9/2012 |
| WO | 2013/190551 | A1 | 12/2013 |
| WO | 2014113891 | A1 | 7/2014 |

OTHER PUBLICATIONS

Perez-Gonzalez, F. et al., Road Vehicle Speed Estimation From a Two-Mircophone Array, Departamento de Teoria de la Senal y las Comunicaciones, Vigo Univ. DOI: 10.1109/ICASSP.2002.5744046 Conference: Acoustics, Speech, and Signal Processing, 2002. Proceedings. (ICASSP '02). IEEE International Conference on, vol. 2 Source: IEEE Xplore.

Pallet Detection on Forklifts: Precise Positioning with Varikont L2 Ultrasonic Sensors, http://www.pepperlfuchs. com/global/en/22595.htm, Pepper+Fuchs, 2016.

De Coensel, Bert, et al., Smart Sound Monitoring for Sound Event Detection and Characterization, Inter-noise 2014.

International Search Report and Written Opinion from related international patent application No. PCT/US2017/050250 dated Nov. 13, 2017.

International Search Report and Written Opinion from related International Patent Application No. PCT/US2017/050492 dated Jan. 2, 2018.

International Search Report and Written Opinion from related International Patent Application No. PCT/US2017/050429 dated Jan. 2, 2018.

U.S. Appl. No. 15/698,052, filed Sep. 7, 2017, Pending.

U.S. Appl. No. 15/698,055, filed Sep. 6, 2017, Pending.

* cited by examiner

SYSTEM AND METHODS FOR IDENTIFYING AN ACTION OF A FORKLIFT BASED ON SOUND DETECTION

CROSS-REFERENCE TO RELATED PATENT APPLICATION

This application claims priority to U.S. Provisional Application No. 62/393,765 filed on, Sep. 13, 2016, the content of which is hereby incorporated by reference in its entirety.

BACKGROUND

It can be difficult to keep track of various actions performed by a forklift in a large facility.

BRIEF DESCRIPTION OF DRAWINGS

Illustrative embodiments are shown by way of example in the accompanying drawings and should not be considered as a limitation of the present disclosure.

DETAILED DESCRIPTION

Figure 1:
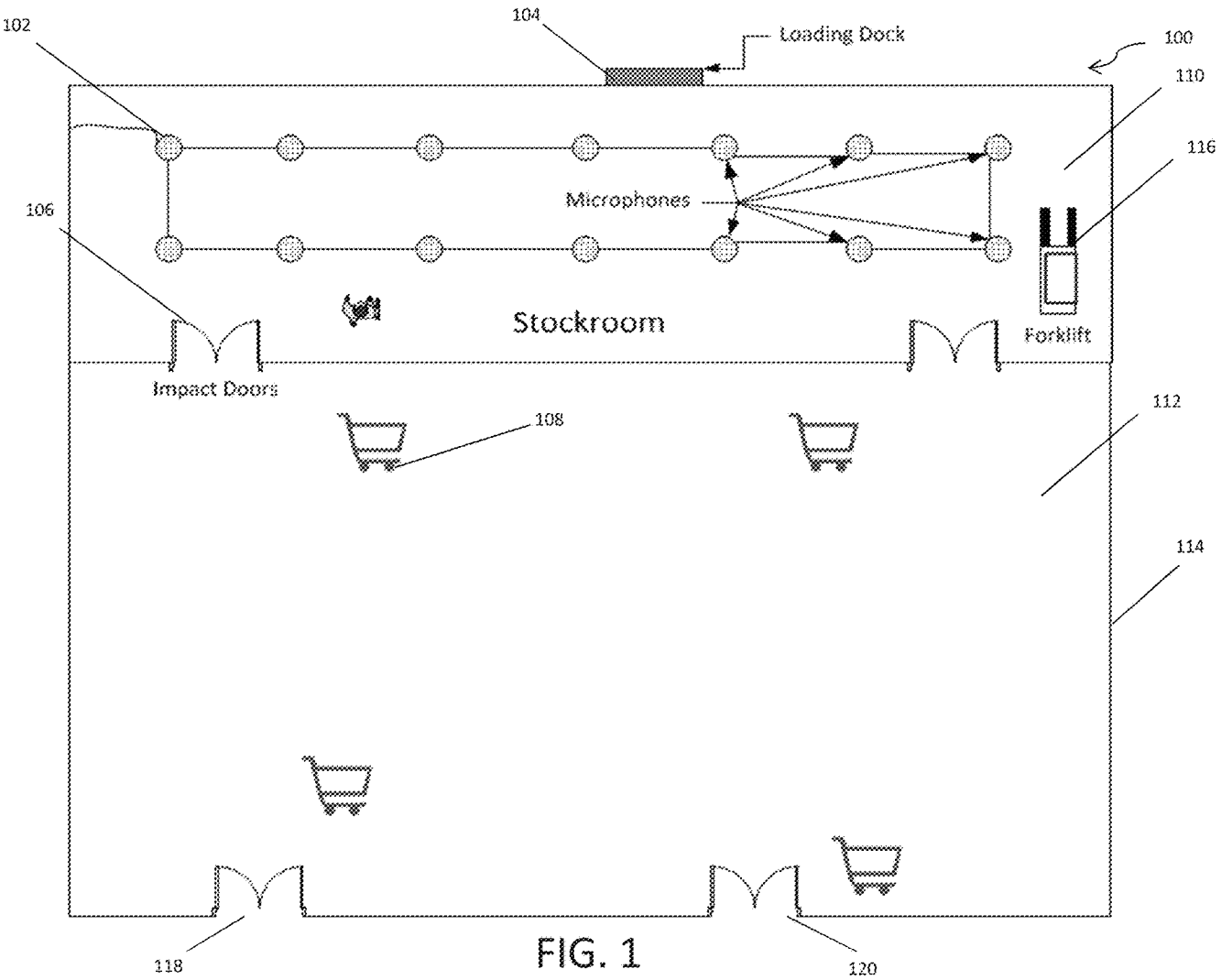
FIG. 1 is a block diagram of microphones disposed in a facility according to the present disclosure.

Described in detail herein are methods and systems for identifying actions performed by a forklift based on detected sounds in a facility. For example, forklift action identification systems and methods can be implemented using an array of microphones disposed in a facility, a data storage device, and a computing system operatively coupled to the microphones and the data storage device.

The array of microphones can be configured to detect various sounds which can be encoded in electrical signals that are output by the microphones. For example, the microphones can be configured to detect sounds and output time varying electrical signals upon detection of the sounds. The microphones can be configured to detect intensities, amplitudes, and frequencies of the sounds and encode the intensities, amplitudes, and frequencies of the sounds in the time varying electrical signals. The microphones can transmit the (time varying) electrical signals encoded with the sounds to the computing system. In some embodiments, the array of microphones can be disposed in a specified area of a facility.

The computing system can be programmed to receive the electrical signals from the microphones, identify the sounds detected by the microphones based on the time varying electric signals, determine time intervals between the sounds encoded in the time varying electrical signals, identify an action that produced at least some of the sounds in response to identifying the sounds and determining the time intervals between the sounds.

The computing system can identify the sounds encoded in the time varying electrical signals based on sound signatures. For example, the sound signatures can be stored in the data storage device and can be selected based on the intensity, amplitude, and frequency of the sounds encoded in each of the time varying electrical signals. The computing system can discard electrical signals received from one or more of the microphones in response to a failure to identify at least one of the sounds represented by the at least one of the electrical signals. In some embodiments, the computing system can be programmed to determine a distance between at least one of the microphones and an origin of at least one of the sounds based on the intensity of the at least one of the sounds detected by at least a subset of the microphones. The computing system can locate the forklift based on the intensities or amplitudes of the sounds encoded in the time varying electrical signals detect by the subset of the microphones.

The computing system can determine a chronological order in which the sounds generated by the forklift are detected by the microphones and/or when the computing system receives the electrical signals. The computing system can be programmed to identify the action being performed by the forklift that produced at least some of the sounds based on matching the chronological order in which the sounds are detected to a set of sound patterns. Embodiments of the computing system can be programmed to identify the action being performed by the forklift that produced at least some of the sounds based on the chronological order matching a threshold percentage of a sound pattern in a set of sound patterns.

Based on the sound signatures, a chronological order in which the sounds occur, an origin of the sounds, a time interval between consecutive sounds, parameters of the time varying electrical signals, a location of the subset of the microphones that detect the sound(s), and/or a time at which the time varying electrical signals are produced, the computing system can determine an action being performed by a forklift that caused the sounds. At least one of the parameters of the time varying electrical signals is indicative of whether a forklift is carrying a load. Upon identifying an action being performed by the forklift based on the sounds, the computing system can perform one or more operations, such as issuing alerts, determining whether the detected activity corresponds to an expected activity of the forklift, e.g., based on the location at which the forklift is detected, the time at which the activity is occurring, and/or the sequence of the sound signatures (e.g., the sound pattern).

At least one of the sound signatures can correspond to one or more of: a fork of the forklift being raised laden; a fork of the forklift being raised empty; a fork of the forklift being lowered laden, a fork of the forklift being lowered empty, a forklift being driven laden, a forklift being driven empty, a speed at which the forklift is being driven, and a problem with the operation of the forklift. The computing system determines a chronological order in which the time varying electrical signals associated with the sounds are received by the computing system.

FIG. 1 is a block diagram of an array of microphones 102 disposed in a facility 114 according to the present disclosure. The microphones 102 can be disposed in first location 110 of a facility 114. The microphones 102 can be disposed at a predetermined distance from one another and can be disposed throughout the first location. The microphones 102 can be configured to detect sounds in the first location 110 including sounds made by forklifts 116. Each of the microphones 102 have a specified sensitive and frequency response for detecting sounds. The microphones 102 can detect the intensity of the sounds which can be used to determine the distance between one or more of the microphones and a location where the sound was produced (e.g., a source or origin of the sound). For example, microphones closer to the source or origin of the sound can detect the sound with greater intensity or amplitude than microphones that are farther away from the source or origin of the sound. Locations of the microphones that are closer to the source or origin of the sound can be used to estimate a location of the origin or source of the sound.

The first location 110 can include doors 106 and a loading dock 104. The first location can be adjacent to a second location 112. The microphones can detect sounds made by a forklift including but not limited to: a fork of the forklift being raised laden; a fork of the forklift being raised empty; a fork of the forklift being lowered laden, a fork of the forklift being lowered empty, a forklift being driven laden, a forklift being driven empty, a speed at which the forklift is being driven, and a problem with the operation of the forklift. Furthermore, the microphones 102 can detect sounds of the doors, sounds generated at the loading dock, and sounds generated by physical objects entering from the second location 112 first location 110. The second location can include a first and second entrance door 118 and 120. The first and second entrance doors 118 and 120 can be used to enter and exit the facility 114.

As an example, a forklift 116 can carry physical objects and transport the physical objects around the first location 110 of the facility 114. The array of microphones 102 can detect the sounds created by forklift 116 carrying the physical objects. Each of the microphones 102 can detect intensities, amplitudes, and/or frequency for each sound generated by a forklift in the first location 110. Because the microphones are geographically distributed within the first location 110, microphones that are closer to the forklift 116 can detect the sounds with greater intensities or amplitudes as compared to microphones that are farther away from the loading dock 104. As a result, the microphones 102 can detect the same sounds, but with different intensities or amplitudes based on a distance of each of the microphones to the forklift 116. The microphones 102 can also detect a frequency of each sound detected. The microphones 102 can encode the detected sounds (e.g., intensities or amplitudes and frequencies of the sound in time varying electrical signals). The time varying electrical signals can be output from the microphones 102 and transmitted to a computing system for processing.

Figure 2:
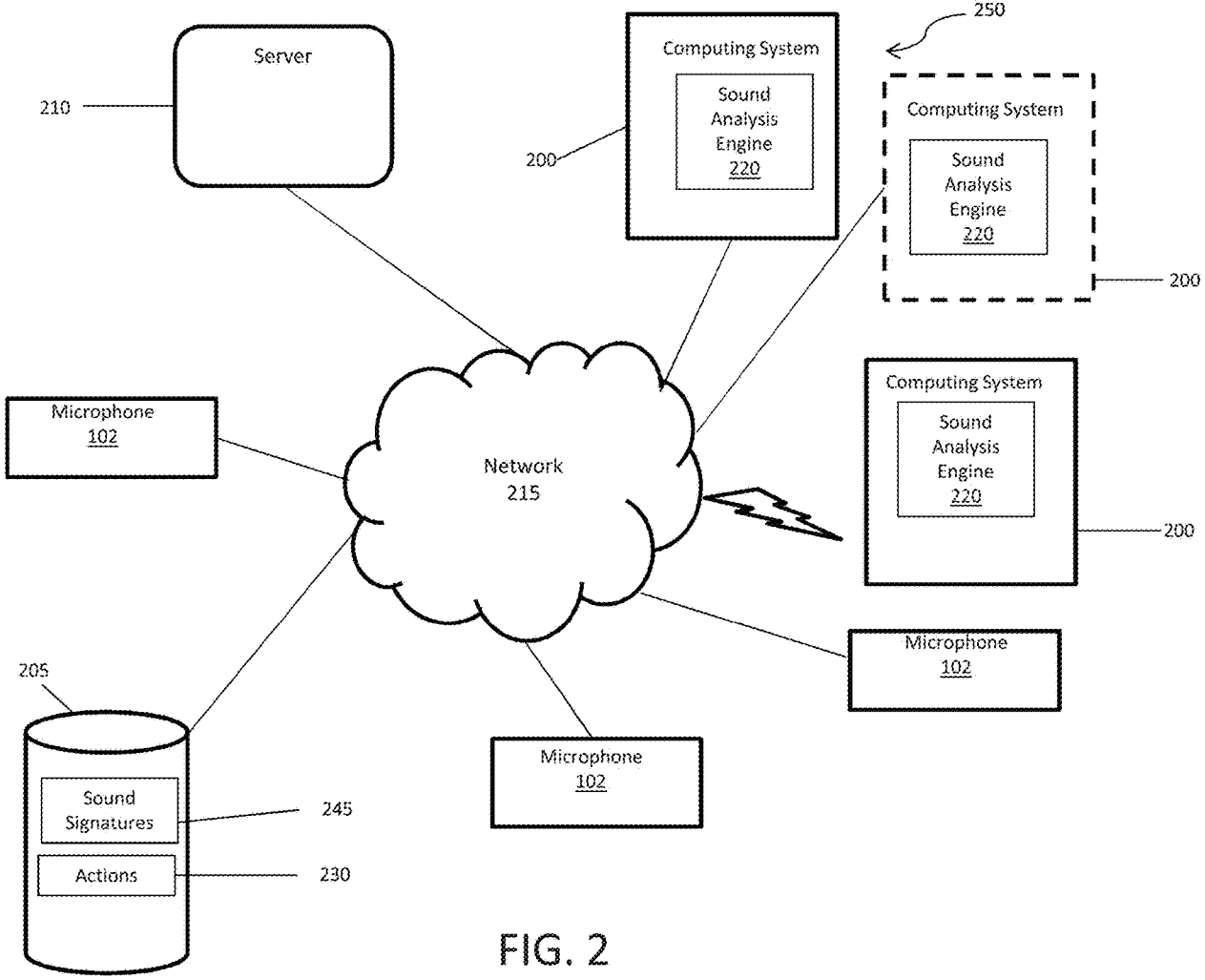
FIG. 2 illustrates an exemplary forklift action identification system in accordance with exemplary embodiments of the present disclosure.

FIG. 2 illustrates an exemplary forklift action identification system 250 in accordance with exemplary embodiments of the present disclosure. The forklift action identification system 250 can include one or more databases 205, one or more servers 210, one or more computing systems 200 and multiple instances of the microphones 102. In exemplary embodiments, the computing system 200 can be in communication with the databases 205, the server(s) 210, and multiple instances of the microphones 102, via a communications network 215. The computing system 200 can implement at least one instance of the sound analysis engine 220.

In an example embodiment, one or more portions of the communications network 215 can be an ad hoc network, an intranet, an extranet, a virtual private network (VPN), a local area network (LAN), a wireless LAN (WLAN), a wide area network (WAN), a wireless wide area network (WWAN), a metropolitan area network (MAN), a portion of the Internet, a portion of the Public Switched Telephone Network (PSTN), a cellular telephone network, a wireless network, a WiFi network, a WiMax network, any other type of network, or a combination of two or more such networks.

The server 210 includes one or more computers or processors configured to communicate with the computing system 200 and the databases 205, via the network 215. The server 210 hosts one or more applications configured to interact with one or more components computing system 200 and/or facilitates access to the content of the databases 205. In some embodiments, the server 210 can host the sound analysis engine 220 or portions thereof. The databases 205 may store information/data, as described herein. For example, the databases 205 can include an actions database 230 and sound signatures database 245. The actions database 230 can store sound patterns (e.g., sequences of sounds or sound signatures) associated with known actions generated by the forklifts. The sound signature database 245 can store sound signatures based on amplitudes, frequencies, and/or durations of known sounds. The databases 205 and server 210 can be located geographically distributed locations from each other or from the computing system 200. Alternatively, the databases 205 can be included within server 210.

In exemplary embodiments, the computing system 200 can receive a multiple electrical signals from the microphones 102 or a subset of the microphones, where each of the time varying electrical signals are encoded with sounds (e.g., detected intensities, amplitudes, and frequencies of the sounds). The computing system 200 can execute the sound analysis engine 220 in response to receiving the time-varying electrical signals. The sound analysis engine 220 can decode the time-varying electrical signals and extract the intensity, amplitude and frequency of the sound. The sound analysis engine 220 can determine the distance of the microphones 102 to the location where the sound occurred based on the intensity or amplitude of the sound detected by each microphone. The sound analysis engine 220 can estimate the location of each sound based on the distance of the microphone from the sound detected by the microphone. In some embodiments, the location and of the sound can be determined using triangulation or trilateration. For example, the sound analysis engine 220 can determine the location of the sounds based on the sound intensity detected by each of the microphones 102 that detect the sound. Based on the locations of the microphones, the sound analysis engine can use triangulation and/or trilateration to estimate the location of the sound, knowing the microphones 102 which have detected a higher sound intensity are closer to the sound and the microphones 102 that have detected a lower sound intensity are farther away. The sound analysis engine 220 can query the sound signature database 245 using the amplitude and frequency to retrieve the sound signature of the sound. The sound analysis engine 220 can determine whether the sound signature corresponds to a sound generated by a forklift. In response to determining the sound is not generated by a forklift, the sound analysis engine 220 can be executed by the computer system to discard the electrical signal associated with the sound. The sound signature can be one of but is not limited to: a fork of the forklift being raised laden; a fork of the forklift being raised empty; a fork of the forklift being lowered laden, a fork of the forklift being lowered empty, a forklift being driven laden, a forklift being driven empty, a speed at which the forklift is being driven, and a problem with the operation of the forklift. The speed of the forklift can be determined by the frequency of the sound. For example, the higher the frequency of the sound generated by the forklift, the faster the forklift is traveling. Furthermore, the loading on the forklift can be determined by the amplitude of the sound.

The computing system 200 can execute the sound analysis engine 220 to determine the chronological order in which the sounds occurred based on when the computing system 200 received each electrical signal encoded with each sound.

The computing system 200, via execution of the sound analysis engine 220, can determine time intervals between each of the detected sounds based on the determined time interval. The computing system 200 can execute the sound analysis engine 220 to determine a sound pattern created by the forklift based on the identification of each sound, the chronological order of the sounds and time intervals between the sounds. In response to determining the sound pattern of the forklift, the computing system 200 can query the actions database 230 using the determined action performed by the forklift in response to matching the sound pattern of the forklift to a sound pattern stored in the actions database 230 within a predetermined threshold amount (e.g., a percentage). In some embodiments, in response to the sound analysis engine 220 being unable to identify a particular sound, the computing system 200 can discard the sound when determining the sound pattern. The computing system 200 can issue an alert in response to identifying the action of the forklift.

In some embodiments, the sound analysis engine 220 can receive and determine that an identical or nearly identical sound was detected by multiple microphones, encoded in various electrical signals, with varying intensities. The sound analysis engine 220 can determine a first electrical signal is encoded with the highest intensity as compared to the remaining electrical signals encoded with the same sound. The sound analysis 220 can query the sound signature database 245 using the sound, intensity, amplitude, and/or frequency of the first electrical signal to retrieve the identification of the sound encoded in the first electrical signal and discard the remaining electrical signals encoded with the same sound but with lower intensities than the first electrical signal.

As a non-limiting example, the forklift action identification system 250 can be implemented in a retail store. An array of microphones can be disposed in a stockroom of a retail store. One or more forklifts can be disposed in the stockroom or the facility. A plurality of products sold at the retail store can be stored in the stockroom in shelving units. The stockroom can also include impact doors, transportation devices such as forklifts, and a loading dock entrance. Shopping carts can be disposed in the facility and can enter the stock room at various times. The microphones can detect sounds in the retail store including but not limited to a fork of the forklift being raised laden; a fork of the forklift being raised empty; a fork of the forklift being lowered laden, a fork of the forklift being lowered empty, a forklift being driven laden, a forklift being driven empty, a speed at which the forklift is being driven, and a problem with the operation of the forklift, a truck arriving, a truck unloading products, a pallet of a truck being operated unloading of the products, an empty shopping cart being operated, a full shopping cart being operated and impact doors opening and closing.

For example, a microphone (out of the array of microphones) can detect a sound of a forklift being driven around the stockroom without a load (e.g., an empty fork). The microphone can encode the sound, the intensity, the amplitude, and/or the frequency of the sound of the forklift being driven around the stockroom without a load in a first electrical signal and transmit the first electrical signal to the computing system 200. Subsequently, after a first time interval, the microphone can detect a sound of the fork of the unloaded forklift being raised. The microphone can encode the sound, intensity, amplitude, and/or frequency of the of the sound of the fork of the unloaded forklift being raised in a second electrical signal and transmit the second electrical signal to the computing system 200. Thereafter, after a second time interval, the microphone can detect a sound of the fork of the forklift being lowered while supporting a load. The microphone can encode the sound, the intensity, the amplitude, and/or the frequency of the sound of the fork of the loaded forklift being lowered in a third electrical signal and transmit the third electrical signal to the computing system 200. In some embodiments different microphones from the array of microphones can detect the sounds at the different time intervals.

The computing system 200 can receive the first, second and third electrical signals. The computing system 200 can automatically execute the sound analysis engine 220. The sound analysis engine 220 can be executed by the computing system 200 to decode the sound, intensity, amplitude, and/or frequency from the first second and third electrical signals. The sound analysis engine 220 can query the sound signature database 245 using the sound, intensity, amplitude, and/or frequency decoded from the first, second and third electrical signals to retrieve the identification the sounds encoded in the first, second and third electrical signals, respectively. The sound analysis engine 220 can also determine the fullness and speed of the forklift based on the intensity, amplitude, and/or frequency of the sounds generated by the forklift and encoded in the first, second and third electrical signals. The sound analysis engine 220 can transmit the identification of sounds encoded in the first, second and third electrical signals, respectively, to the computing system 200. For example, sound analysis engine 220 can be executed by the computing system to identify the sound encoded in the first electrical signal based on a sound signature for a forklift being driven around the stockroom with an empty fork. The sound analysis engine 220 can identify the sound encoded in the second electrical signal based on a sound signature for empty fork of the forklift being raised. The sound encoded in the third signature can be associated to a sound signature a fork of a forklift being lowered laden.

The computing system 200 can determine the chronological order sounds based on the time the computing system 200 received the first, second and third electrical signals. For example, the computing system 200 can execute the sound analysis engine 220 to determine a forklift was being driven around the stockroom with an empty fork before the empty fork of the forklift was raised, and that the fork of the forklift is lowered laden after the fork of the forklift was raised. The computing system 200 can determine the time interval in between the sounds based on the times at which the computing system received the first, second and third electrical signals (e.g., first through third time intervals). For example, the computing system 200 can determine sound of the a forklift being driven around the stockroom with an empty fork occurred two minutes before the fork of the forklift was raised empty which occurred one minute before the fork of the forklift was lowered laden based on receiving the first electrical signal two minutes before the second electrical signal and receiving the third electrical signal one minute after the second electrical signal. In response to determining the chronological order of the sounds and the time interval between the sounds, the computing system 200 can determine a sound pattern (e.g., a sequence of sound signatures). The computing system 200 can query the actions database 200 using the determined sound pattern to identify the action of the forklift based on matching the determined sound pattern to a stored sound pattern within a predetermined threshold amount (e.g., a percentage matched). For example, the computing system 200 can determine the action of products are being loaded onto the forklift based on the sounds encoded in the first, second and third electrical signals. The computing system 200 can also determine the speed of the forklift while it is been driven around. The computing system 200 can transmit an alert to an employee with respects to the speed of the forklift and/or the location or timing of the loading of the products on to the forklift.

Figure 3:
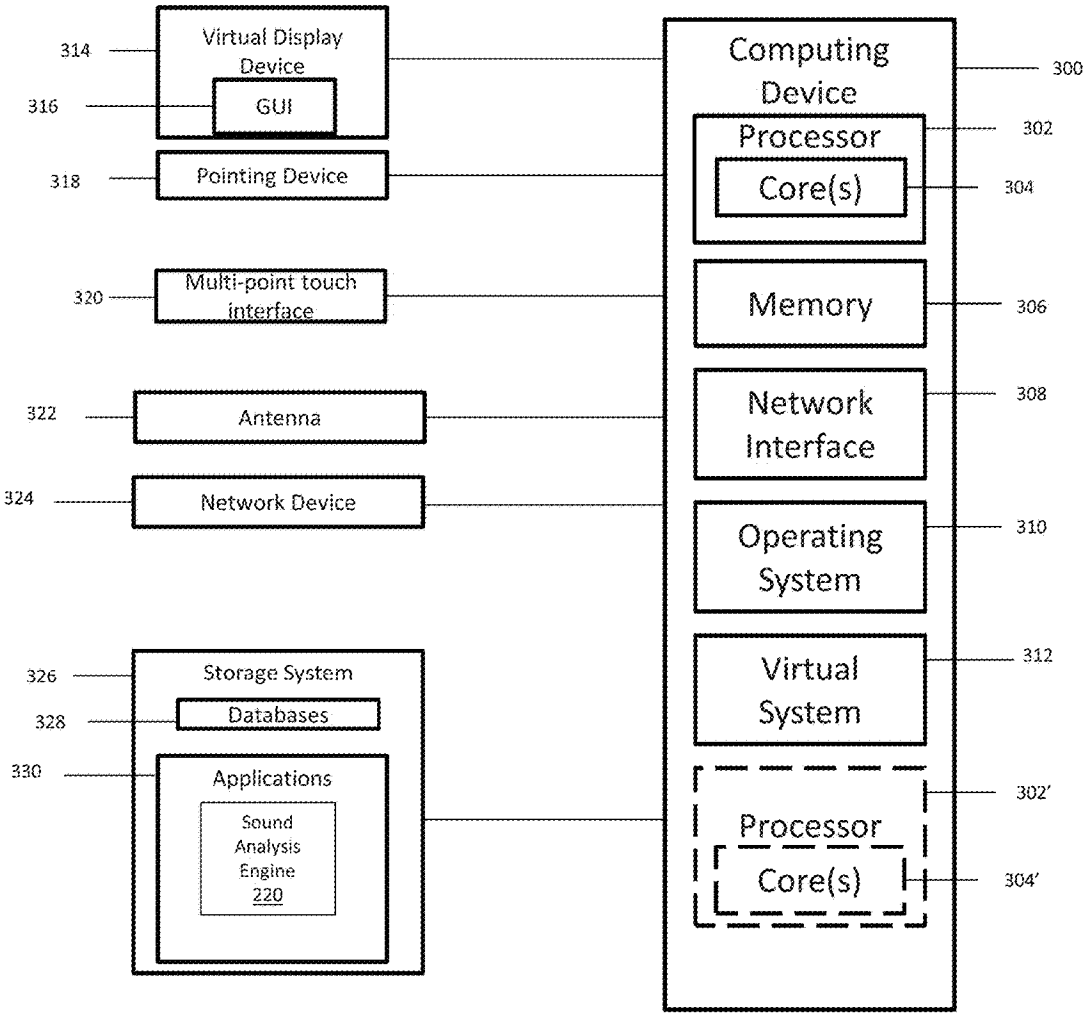
FIG. 3 illustrates an exemplary computing device in accordance with exemplary embodiments of the present disclosure.

FIG. 3 is a block diagram of an example computing device for implementing exemplary embodiments of the present disclosure. Embodiments of the computing device 300 can implement embodiments of the sound analysis engine. The computing device 300 includes one or more non-transitory computer-readable media for storing one or more computer-executable instructions or software for implementing exemplary embodiments. The non-transitory computer-readable media may include, but are not limited to, one or more types of hardware memory, non-transitory tangible media (for example, one or more magnetic storage disks, one or more optical disks, one or more flash drives, one or more solid state disks), and the like. For example, memory 306 included in the computing device 300 may store computer-readable and computer-executable instructions or software (e.g., applications 330 such as the sound analysis engine 220) for implementing exemplary operations of the computing device 300. The computing device 300 also includes configurable and/or programmable processor 302 and associated core(s) 304, and optionally, one or more additional configurable and/or programmable processor(s) 302' and associated core(s) 304' (for example, in the case of computer systems having multiple processors/cores), for executing computer-readable and computer-executable instructions or software stored in the memory 306 and other programs for implementing exemplary embodiments of the present disclosure. Processor 302 and processor(s) 302' may each be a single core processor or multiple core (304 and 304') processor. Either or both of processor 302 and processor(s) 302' may be configured to execute one or more of the instructions described in connection with computing device 300.

Virtualization may be employed in the computing device 300 so that infrastructure and resources in the computing device 300 may be shared dynamically. A virtual machine 312 may be provided to handle a process running on multiple processors so that the process appears to be using only one computing resource rather than multiple computing resources. Multiple virtual machines may also be used with one processor.

Memory 306 may include a computer system memory or random access memory, such as DRAM, SRAM, EDO RAM, and the like. Memory 306 may include other types of memory as well, or combinations thereof.

A user may interact with the computing device 300 through a visual display device 314, such as a computer monitor, which may display one or more graphical user interfaces 316, multi touch interface 320 and a pointing device 318.

The computing device 300 may also include one or more storage devices 326, such as a hard-drive, CD-ROM, or other computer readable media, for storing data and computer-readable instructions and/or software that implement exemplary embodiments of the present disclosure (e.g., applications). For example, exemplary storage device 326 can include one or more databases 328 for storing information regarding the sounds produced by forklift actions taking place a facility and sound signatures. The databases 328 may be updated manually or automatically at any suitable time to add, delete, and/or update one or more data items in the databases.

The computing device 300 can include a network interface 308 configured to interface via one or more network devices 324 with one or more networks, for example, Local Area Network (LAN), Wide Area Network (WAN) or the Internet through a variety of connections including, but not limited to, standard telephone lines, LAN or WAN links (for example, 802.11, T1, T3, 56 kb, X.25), broadband connections (for example, ISDN, Frame Relay, ATM), wireless connections, controller area network (CAN), or some combination of any or all of the above. In exemplary embodiments, the computing system can include one or more antennas 322 to facilitate wireless communication (e.g., via the network interface) between the computing device 300 and a network and/or between the computing device 300 and other computing devices. The network interface 308 may include a built-in network adapter, network interface card, PCMCIA network card, card bus network adapter, wireless network adapter, USB network adapter, modem or any other device suitable for interfacing the computing device 300 to any type of network capable of communication and performing the operations described herein.

The computing device 300 may run any operating system 310, such as any of the versions of the Microsoft® Windows® operating systems, the different releases of the Unix and Linux operating systems, any version of the MacOS® for Macintosh computers, any embedded operating system, any real-time operating system, any open source operating system, any proprietary operating system, or any other operating system capable of running on the computing device 300 and performing the operations described herein. In exemplary embodiments, the operating system 310 may be run in native mode or emulated mode. In an exemplary embodiment, the operating system 310 may be run on one or more cloud machine instances.

Figure 4:
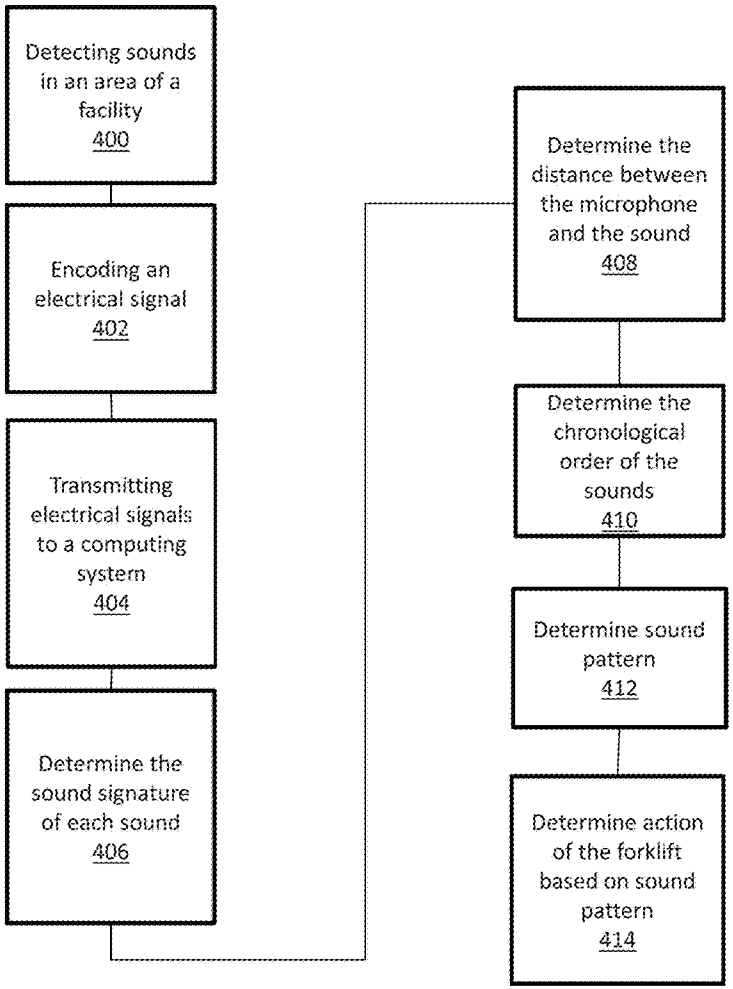
FIG. 4 is a flowchart illustrating a forklift action identification system according to exemplary embodiments of the present disclosure.

FIG. 4 is a flowchart illustrating process implemented by a forklift action identification system according to exemplary embodiments of the present disclosure. In operation 400, an array of microphones (e.g. microphones 102 shown in FIG. 1) disposed in a first location (e.g. first location 110 shown in FIG. 1) in a facility (e.g. facility 114 shown in FIG. 1) can detect sounds generated by actions performed in the first location of the facility. The first location can include shelving units, an entrance to a loading dock (e.g. loading dock entrance 104 shown in FIG. 1), impact doors (e.g. impact doors 106 shown in FIG. 1). The microphones can detect sounds produced by a forklift (e.g. forklift 116 shown in FIG. 1). The first location can be adjacent to a second location (e.g. second location 112 shown in FIG. 1). The second location can include a first and second entrance (e.g. first and second entrances 118 and 120 shown in FIG. 1) to the facility. The sounds can be generated by the impact doors, forklifts, and actions occurring at the loading dock.

In operation 402, the microphones can encode each sound including an intensity, amplitude, and/or frequency of each of the sounds into time varying electrical signals. The intensity or amplitude of the sounds detected by the microphones can depend on the distance between the microphones and the location at which the sound originated. For example, the greater the distance a microphone is from the origin of the sound, the lower the intensity or amplitude of the sound when it is detected by the microphone. Likewise, the frequencies of sounds generated by the forklift can be indicative a state of operation of the forklift. For example, the greater the frequency of the sounds generated by the forklift, the greater the speed of the forklift, the greater the load being carried by the forklift, and the like. The intensity or amplitude of the sound can also determine the speed of the forklift and/or loading of the forklift. In operation 404, the microphones can transmit the encoded time-varying electrical signals to the computing system. The microphones can transmit the time-varying electrical signals as the sounds are detected.

In operation 406, the computing system can receive the time-varying electrical signals, and in response to receiving the time-varying electrical signals, the computing system can execute embodiments of the sound analysis engine (e.g. sound analysis engine 220 as shown in FIG. 2), which can decode the time varying electrical signals and extract the detected sounds (e.g., the intensities, amplitudes, and/or frequencies of the sounds). The computing system can execute the, the sound analysis engine to query the sound signature database (e.g. sound signature database 245 shown in FIG. 2) using the intensities, amplitudes and/or frequencies encoded in the time varying electrical signals to retrieve sound signatures corresponding to the sounds encoded in the time varying electrical signal. The sound analysis engine can identify the sounds as being generated by a forklift, and based on the sound signatures, the action of the forklift can be identified as well. For example the sound signatures can indicate the forklift is performing the following actions: a fork of the forklift being raised laden; a fork of the forklift being raised empty; a fork of the forklift being lowered laden, a fork of the forklift being lowered empty, a forklift being driven laden, a forklift being driven empty, a speed at which the forklift is being driven, and a problem with the operation of the forklift. The sound analysis engine can also determine the speed of the forklift based on the frequency of the sound and the fullness of the fork of the forklift based on the intensity of the sound. In some embodiments, in response to determining the sound is not generated by a forklift the sound analysis engine can discard the sound.

In operation 408, the sound analysis engine can be executed by the computing system to estimate a distance between the microphones and the location of the occurrence of the sound based on intensities or amplitudes of the sound as detected by the microphones. The sound analysis engine be executed to determine identification of the sounds encoded in the time-varying electrical signals based on the sound signature and the distance between the microphone and occurrence of the sound.

In operation 410, the computing system can determine a chronological order in which the identified sounds occurred based on the order in which the time varying electrical signals were received by the computing system. The computing system can also determine the time intervals between the sounds in the time varying electrical signals based on the time interval between receiving the time-varying electrical signals. In operation 412, the computing system can determine a sound pattern (e.g., a sequence of sound signatures) based on the identification of the sounds, the chronological order of the sounds and the time intervals between the sounds.

In operation 414, the computing system can determine the action of the forklift generating the sounds detected by the array of microphones by querying the actions database (e.g. actions database 230 in FIG. 2) using the sound pattern to match a detected sound pattern of an action to a stored sound pattern within a predetermined threshold amount (e.g., percentage).

In describing exemplary embodiments, specific terminology is used for the sake of clarity. For purposes of description, each specific term is intended to at least include all technical and functional equivalents that operate in a similar manner to accomplish a similar purpose. Additionally, in some instances where a particular exemplary embodiment includes a plurality of system elements, device components or method steps, those elements, components or steps may be replaced with a single element, component or step. Likewise, a single element, component or step may be replaced with a plurality of elements, components or steps that serve the same purpose. Moreover, while exemplary embodiments have been shown and described with references to particular embodiments thereof, those of ordinary skill in the art will understand that various substitutions and alterations in form and detail may be made therein without departing from the scope of the present disclosure. Further still, other aspects, functions and advantages are also within the scope of the present disclosure.

Exemplary flowcharts are provided herein for illustrative purposes and are non-limiting examples of methods. One of ordinary skill in the art will recognize that exemplary methods may include more or fewer steps than those illustrated in the exemplary flowcharts, and that the steps in the exemplary flowcharts may be performed in a different order than the order shown in the illustrative flowcharts.

We claim:

1. A system for identifying actions of a forklift based on detected sounds produced by the forklift or an environment within which the forklift is operated, the system comprising:

an array of microphones disposed in a first area of a facility, the microphones being configured to detect sounds and output time varying electrical signals upon detection of the sounds; and a computing system operatively coupled to the array of microphones, the computing system programmed to:

receive the time varying electrical signals associated with the sounds detected by at least a subset of the microphones; and detect an operation being performed by the forklift based on parameters of the time varying electrical signals, a location of the subset of the microphones, and a time at which the time varying electrical signals are produced, wherein at least one of the parameters of the time varying electrical signals is indicative of whether a forklift is carrying a load.

2. The system in claim 1, wherein the microphones are further configured to detect intensities of the sounds and encode the intensities of the sound in the time varying electrical signals.

3. The system in claim 2, wherein the computing system is further programmed to locate the forklift based on based on the intensities of the sounds encoded in the time varying electrical signals.

4. The system in claim 1, wherein the computing system generates sound signatures for the sounds based on the time varying electric signals.

5. The system of claim 4, wherein at least one of the sound signatures correspond to one or more of: a fork of the forklift being raised laden; a fork of the forklift being raised empty; a fork of the forklift being lowered laden, a fork of the forklift being lowered empty, a forklift being driven laden, a forklift being driven empty, a speed at which the forklift is being driven, and a problem with the operation of the forklift.

6. The system in claim 1, wherein the computing system determines a chronological order in which the time varying electrical signals associated with the sounds are received by the computing system.

7. The system in claim 1, wherein amplitudes and frequencies of the sounds detected by the subset of the microphones are encoded in the time varying electrical signals.

8. The system in claim 7, wherein the computing system determines sound signatures for the sounds based on the amplitude and the frequency encoded in the time varying electrical signals.

9. The system in claim 8, wherein the computing system is programmed to determine the activity of the forklift based on the sound signatures.

10. The system in claim 9, wherein the computing system is programmed to determine whether the activity corresponds to an expected activity of the forklift based on a location at which the forklift is detected, a time at which the activity is occurring, and a sequence of the sound signatures.

11. A method for identifying actions of a forklift based on detected sounds produced by the forklift or an environment within which the forklift is operated, the method comprising:

detecting sounds via an array of microphones disposed in a first area of a facility receiving, via a computing system operatively coupled to the array of the microphones, time varying electrical signals output by at least a subset of the microphones in response to detection of the sounds; and detecting an operation being performed by the forklift based on parameters of the time vary electrical signals, a location of the subset of the microphones, and a time at which the time varying electrical signals are produced, wherein at least one of the parameters of the time varying electrical signals is indicative of whether a forklift is carrying a load.

12. The method in claim 11, further comprising:

detecting, via the microphones, intensities of the sounds; and encoding the intensities of the sound in the time varying electrical signals.

13. The method in claim 12, further comprising locating the forklift based on the intensities of the sounds encoded in the time varying electrical signals.

14. The method in claim 11, further comprising generating, via the computing system, sound signatures for the sounds based on the time varying electric signals.

15. The method of claim 14, wherein at least one of the sound signatures correspond to one or more of: a fork of the forklift being raised laden; a fork of the forklift being raised empty; a fork of the forklift being lowered laden, a fork of the forklift being lowered empty, a forklift being driven laden, a forklift being driven empty, a speed at which the forklift is being driven, and a problem with the operation of the forklift.

16. The method in claim 11, further comprising determining, via a computing system, a chronological order in which the time varying electrical signals associated with the sounds are received by the computing system.

17. The method in claim 11, further comprising:

detecting, via the microphones, amplitudes and frequencies of the sounds; and encoding the amplitudes and frequencies in the time varying electrical signals.

18. The method in claim 17, further comprising determining, via a computing system, sound signatures for the sounds based on the amplitudes and the frequencies encoded in the time varying electrical signals.

19. The method in claim 18, further comprising determining, via a computing system, the activity of the forklift based on the sound signatures.

20. The method in claim 19, further comprising determining, via a computing system, whether the activity corresponds to an expected activity of the forklift based on a location at which the forklift is detected, a time at which the activity is occurring, and a sequence of the sound signatures.

* * * * *